United States Patent [19]

Phillips

[11] 4,133,248

[45] Jan. 9, 1979

[54] SHELL CASING RESIZER

[76] Inventor: Welton E. Phillips, 1820 S. 11th Ave., Yuma, Ariz. 85364

[21] Appl. No.: 831,983

[22] Filed: Sep. 9, 1977

[51] Int. Cl.[2] ..... F42B 33/02

[52] U.S. Cl. ..... 86/23; 86/36

[58] Field of Search ..... 86/23–28, 86/36

[56] References Cited

U.S. PATENT DOCUMENTS 3,979,995 9/1976 Phillips ..... 86/23 X

*Primary Examiner*—Stephen J. Lechert, Jr.

*Attorney, Agent, or Firm*—Berman, Aisenberg & Platt

[57] ABSTRACT

A manually operable, bench mounted press used to resize the brass on shotgun and small arms ammunition prior to reloading. The shell casing resizer comprises a lever-operated ram which acts simultaneously on a pair of complementary resizing dies and ejector assemblies so as to resize one shell while another is being ejected. The resizing dies are formed at opposite ends of a rotating tubular member within which are also positioned the complementary ejector assemblies. An indexing cam is mounted to the outside of the tubular member so as to pivot therewith between the free ends of a pair of support arms of the press. The substantially simultaneous resizing and ejection actions are both the result of a single downward movement of the lever, and return of the lever to its initial position permits manual indexing of the tubular member until the next shell is aligned for the next resizing/ejection stroke.

21 Claims, 4 Drawing Figures

SHELL CASING RESIZER

BACKGROUND OF THE INVENTION

1. Field of the Invention

The present invention is related to machines utilized to resize the diameters of used shell casings and, more particularly, is directed towards a bench mountable and hand operable press utilized for resizing the brass body and rim on shotgun and small arms ammunition prior to reloading.

2. Description of The Prior Art

The state-of-the-art of shell casing resizing machines is fully set forth in my own prior U.S. Pat. No. 3,979,995. In my patent, I teach a vastly improved shell casing resizer which features substantially simultaneous resizing and ejection of a pair of shotgun shells mounted on a pair of oppositely disposed resizing dies. My prior machine may be bench mounted and includes a lever-actuated ram such that, while one shell casing is being pressed within one of the dies, another shell casing, already resized, is being ejected from the opposite die. The resizing and ejection actions occur substantially simultaneously during the downward stroke of the lever.

The machine as set forth in my prior patent also features automatic indexing which operates to alternately rotate each resizing die to its resizing/ejection position in response to the upward stroke of the hand-operated lever. The automatic indexing is achieved, more particularly, by means of a spring-loaded cam actuated alignment arm.

While a great improvement over prior art shell casing resizers, the device set forth in my earilier U.S. Pat. No. 3,979,995 is a bit complex, has many moving parts, and is therefore somewhat costly to manufacture.

Most of the complexities in my previous design centers around the automatic indexing mechanism which serves to rotate the resizing dies 180° upon each upward stroke of the hand-operated lever. While automating the operation, and therefore speeding up the shell-handling capabilities of the machine, overall I feel that the automatic indexing mechanism could be dispensed with in a more basic, simplified and less complex model which could be manufactured and marketed at a price substantially below the original.

OBJECTS AND SUMMARY OF THE INVENTION

It is therefore a primary object of the present invention to provide an improved shell casing resizer which greatly simplifies the design of my previous machine and therefore overcomes all of the deficiencies noted above.

A further object of the present invention is to provide a new and improved shell casing resizer which features unique, cooperating resizing/ejection assemblies, and which permits the resizing dies to be indexed by hand.

An additional object of the present invention is to provide a shell casing resizer which incorporates all of the features of my previous machine, with the exception of the automatic indexing mechanism, and thereby greatly reduces manufacturing costs.

The foregoing and other objects are attained in accordance with one aspect of the present invention through the provision of a machine for resizing used shell casings, which comprises a pair of cooperating die means each of which is adapted to receive a shell casing for resizing same, means for applying force to one of the shell casings to urge same past its associated die means, means further responsive to the force for automatically ejecting the other of the shell casings from the other of the die means, and means coupled to the pair of cooperating die means for permitting manual indexing thereof for successively and alternately positioning each of the pair of die means adjacent the means for applying force to one of the shell casings.

In accordance with more specific aspects of the present invention, the means coupled to the pair of cooperating die means comprises a cam member coupled for rotation with the die means about an indexing axis, and spring means which cooperates with the cam member for causing same to stop rotating at first and second positions which correspond to the placement of the pair of die means adjacent the means for applying force to one of the shell casings. The cam member more particularly comprises a disc-shaped cam having a pair of oppositely disposed notches for receivably retaining the spring means, the latter comprising a spring member having one end secured against movement while the other end is shaped congruently to the shape of the notches. Preferably, the cam further includes an arcuate surface formed about the peripheral edge thereof within which the other end of the spring member is adapted to be guided for positive cam tracking.

In accordance with other aspects of the present invention, the die means comprises a substantially cylindrical tubular member having a pair of resizing dies positioned one at each end thereof. Each of the resizing dies preferably includes an inwardly extending annular lip, and is further threaded so as to be removably attached to each end of the tubular member.

The shell casing resizer preferably includes a main frame having a pair of laterally spaced, elongated support arms between the free end of which is pivotally mounted the tubular member having the threaded dies positioned at each end thereof. The cam member is coupled to the outside of the tubular member for rotation therewith about the indexing axis, an indexing pin being positioned through the cam member, the tubular member and the free end of the support arms for defining the indexing axis. The spring member for stopping the cam member at the notched portions thereof comprises a spring one end of which is secured to one of the support arms, the free end of which is positioned adjacent the cam member for engagement by the peripheral groove thereof.

In accordance with yet other aspects of the present invention, the automatic ejecting means are disposed within the tubular member and include means for permitting lateral movement therein in response to the force applying means. The lateral movement permitting means comprises an elongated slot formed in a central portion of the automatic ejecting means, the indexing pin extending through the elongated slot for defining the limits of movement of the automatic ejecting means. The latter comprises a pair of substantially identical ejection assemblies coupled one to each end of the central portion.

In accordance with more specific aspects of the present invention, each of the ejection assemblies comprises primary ejector means over which the shell casing is placed by the force applying means, the primary ejection means provided for initially ejecting its associated shell casing in response to force applied to the other of the shell casings. Each of the ejection assemblies further comprises secondary springloaded ejector means disposed within the primary ejector means for finally ejecting the associated shell casing from its respective die means. Each of the ejection assemblies further includes a deprimer rod longitudinally positioned therein and coupled at one end thereof to the central portion of the ejection means, and a spring positioned about the deprimer rod and between the central portion and the secondary ejection means for urging the latter outwardly against the inner surface of its associated shell casing.

In accordance with still further aspects of the present invention, the force applying means comprises a hand-operated lever coupled to the main frame for movement between first and second positions, and ram means for reciprocating in response to the movement of said lever, the ram means including a head for directly pressing against one of the shell casings while the lever is being moved from its second position to its first position. More particularly, the hand-operated lever is decoupled from the tubular member while the lever is being moved from its first position back to its second position in order to permit manual indexing of the resizing dies to their next position.

BRIEF DESCRIPTION OF THE DRAWINGS

Other objects, features and attendant advantages of the present invention will be more fully appreciated as the same becomes better understood from the following detailed description of the present invention when considered in connection with the accompanying drawings, in which.

DETAILED DESCRIPTION OF THE PREFERRED EMBODIMENT

Figure 1:
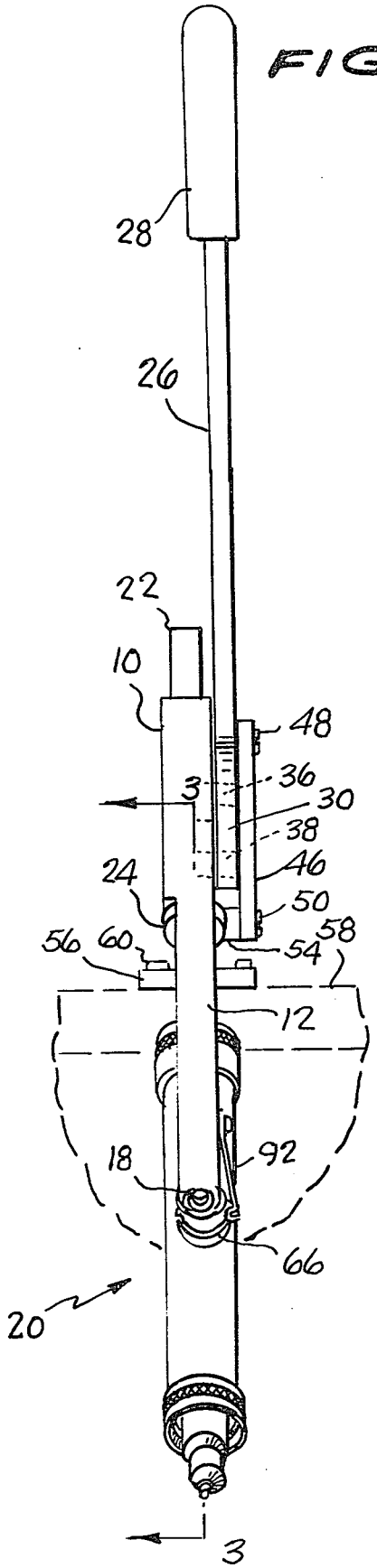
FIG. 1 is a front, plan view of a preferred embodiment of the improved shell casing resizer of the present invention.
Figure 2:
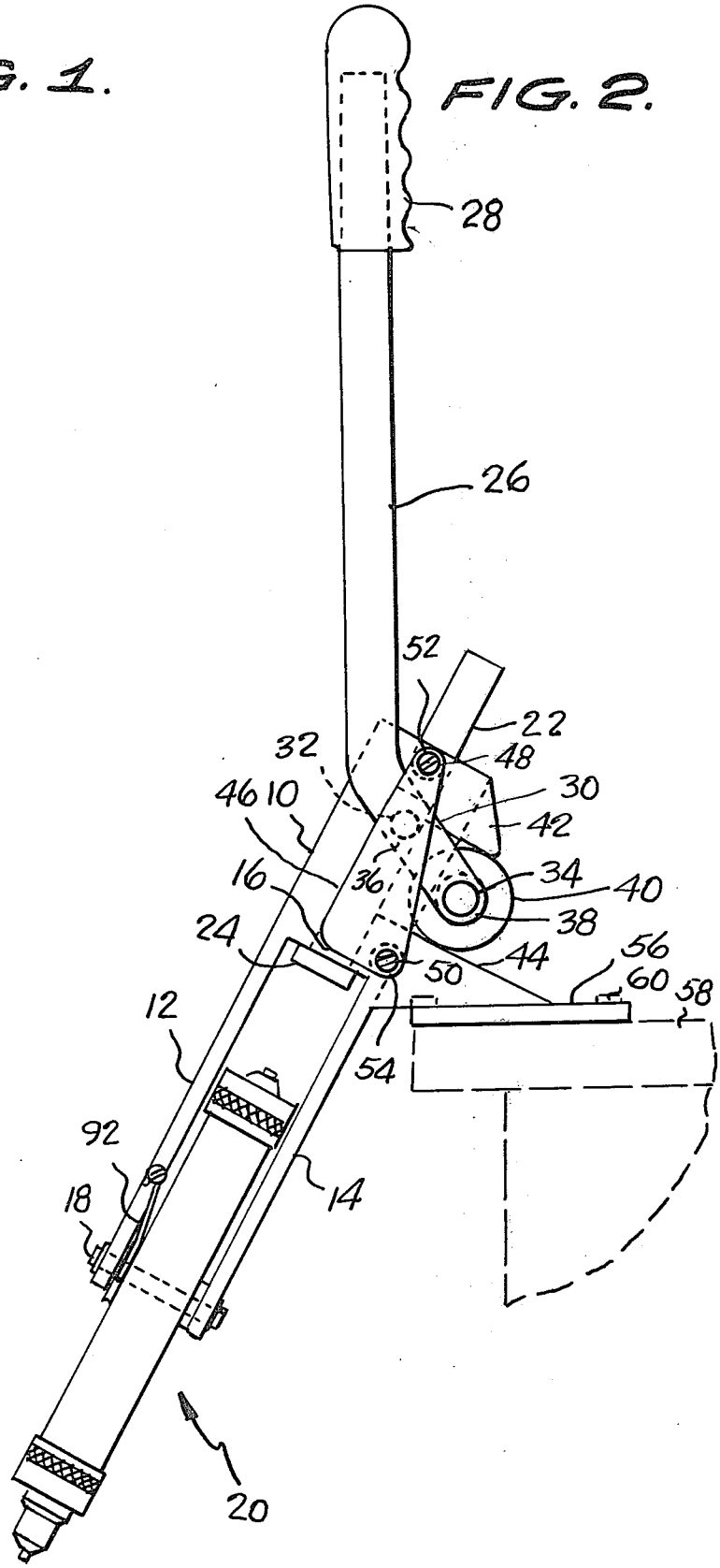
FIG. 2 is a side view of the preferred embodiment illustrated in FIG. 1.

Referring now to the drawings, wherein like reference numerals represent identical or corresponding parts throughout the several views, and more particularly to FIGS. 1 and 2 thereof, the improved shell casing resizer of the present invention is illustrated in respective front and side views in a preferred embodiment and is seen to include a unitary main frame 10 from the lower portion of which extends a pair of parallel, spaced upper and lower support arms 12 and 14, respectively.

Pivotally mounted, as by an indexing pin 18, between the free ends of the upper and lower support arms 12 and 14 is a resizer-ejector assembly which is indicated generally by reference numeral 20 and whose structure will be described in greater detail hereinafter.

At the upper end of frame 10, as seen in FIG. 2, is formed an elongated guide or slot 16 through which an elongated ram 22 is movably mounted. At the lower end of ram 22 is positioned a ram head 24 for applying force directly to the end of a shell casing to be resized within one end of the resizer-ejector assembly 20 adjacent thereto.

A manually actuable handle 26 is provided and includes a rubber or plastic hand grip 28 formed about one end thereof and terminates at the other end in an angled forward arm 30 having a pair of through apertures 32 and 34 formed therein. Within aperture 32 is positioned a ram pin 36 which is also press fit into a similarly sized aperture in the side of the ram member 22. Within aperture 34 is positioned a press reaction pin 38 which is press fit within a press reaction roller 40. The press reaction roller 40 is positioned between a pair of jaws 42 and 44 of the frame 10 and serves as a main pivot bearing for the downward and upward strokes of the handle 26. A triangular cover plate 46 secures the angled forward arm 30 and ram 22 to the side of frame 10 by means of a pair of screws 48 and 50 and respective spacers 52 and 54.

Extending perpendicularly from jaw 44 is a substantially flat mounting flange 56 for securing the frame 10 to a table or support member 58 by means of a plurality of screws or bolts 60.

Figure 3:
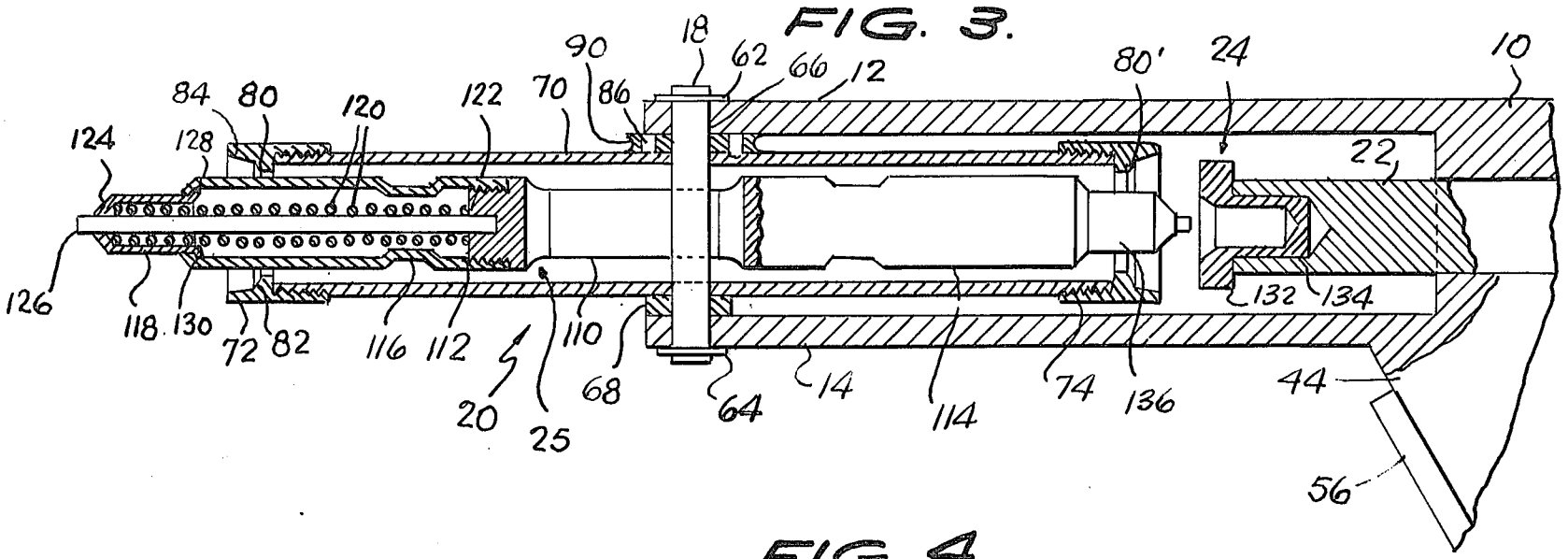
FIG. 3 is an enlarged, partially-sectioned view of a portion of the preferred embodiment shell casing resizer illustrated in FIG. 1 and taken along line 3—3 thereof.
Figure 4:
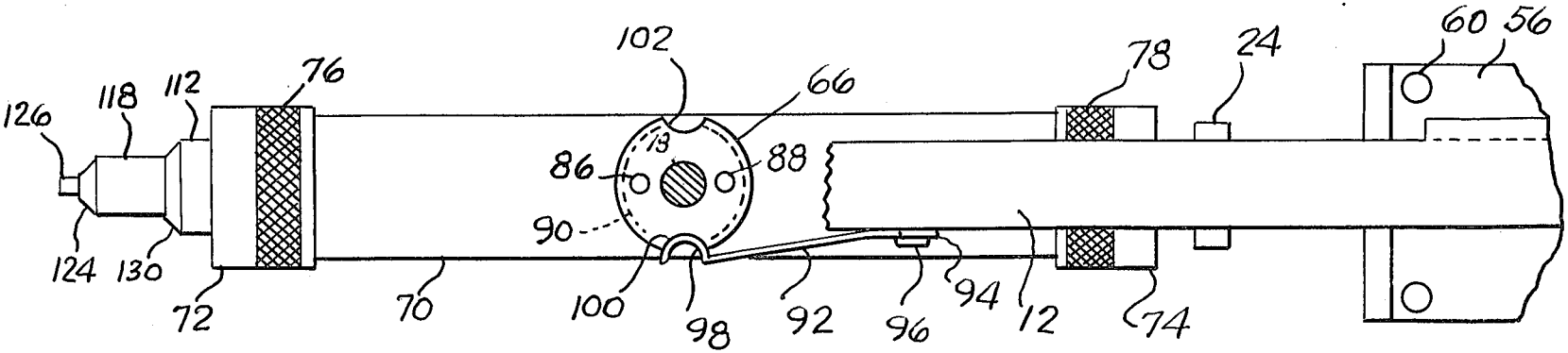
FIG. 4 is a partially broken, top view of the apparatus illustrated in FIG. 3 which is helpful in understanding the operation thereof.

Referring now to FIGS. 3 and 4, the indexing pin 18 is seen to extend through circular apertures formed in the free ends of support arms 12 and 14, a circular aperture formed in the center of a die alignment cam 66, a circular aperture formed in an indexing tube spacer 68, and a pair of circular apertures formed in diametrically opposed positions on an indexing tube 70. A pair of retainer clips 62 and 64 are snap fit within similarly formed grooves near the ends of pin 18 to hold same in place.

The indexing tube 70 comprises a substantially cylindrical, hollow member which is threaded externally at both ends to receive a pair of internally threaded resizing dies 72 and 74. Dies 72 and 74 are preferably knurled on their outer surfaces, as at 76 and 78, to facilitate installation and removal thereof on the respective ends of indexing tube 70. Somewhat inwardly disposed with respect to the open end of each of the resizing dies 72 and 74 is an annular, inwardly extending shell body resizing lip 80 and 80', respectively. Each die also includes a tapered edge 82 positioned adjacent lip 80 for resizing the shell rim, and a shell rim diameter resizing lip 84 which extends from the edge 82 outwardly to the open end of the die. Note that the shell rim diameter resizing lip 84 is preferably tapered slightly which decreases the necessary resizing and extraction forces. Each of the dies 72 and 74 are constructed substantially identically. It is noted that the dies 72 and 74 may be provided in a number of different sizes to accommodate a number of differently sized shells and ammunition so as to render the present invention more versatile.

The automatic indexing mechanism described in my previous U.S. Pat. No. 3,979,995 has been replaced in the present invention by the provision of means which enables the indexing tube 70 and associated resizing dies 72 and 74 to be manually indexed. This means comprises a die alignment cam 66 which consists of a substantially circular disc which is preferably secured, as by welded pins 86 and 88, to the top of indexing tube 70. Cam 66 also has a circular groove 90 which peripherally extends about the outer circumference thereof to provide positive cam tracking for a die alignment spring 92 which is preferably formed of circular stock. One end 94 of spring 92 is secured to the side of the upper support arm 12 as by a screw 96, while the other end 98 is curved or otherwise formed in such a fashion so as to fit within a pair of oppositely disposed cam recesses 100 and 102 formed in the die alignment cam 66.

Within indexing tube 70 is positioned an ejector assembly 25 that includes a center, elongated guide 110 through which indexing pin 18 extends for limiting the lateral movement of the ejector assembly 25 within tube 70. At the same time, the ejector assembly 25 is free to rotate about pin 18 with tube 70 during indexing.

The center guide 110 is threaded at both ends for securing a pair of primary ejector tubes 112 and 114 thereabout. Each ejector 112 and 114 includes a swaged portion 116 and a secondary ejector 118 which extends through an opening at the distal end of the primary ejectors. An ejector spring 120 extends between the outer end 122 of center of guide 110 and the inner end 124 of the secondary ejector 118. A depriming rod 126 is also provided in each primary ejector 112 and 114. The depriming rod extends between an opening in the secondary ejector 118 formed in the outer end 124, the other end of depriming rod 126 being press fit into an aperture formed in the end 122 of center guide 110. The base 128 of secondary ejector 118 is retained within primary ejector 112 by means of an inwardly extending lip 130.

The ram head 24 of the ram 22 is illustrated in cross-sectional detail in FIG. 3 and is seen to include a head portion 132 and a shank portion 134 which is positioned within an aperture formed at the end of ram 22. The shank 134 is held within the hole at the end of the ram by means of, for example, a set screw (not shown). Additionally, shank 134 is hollowed so as to receive the spent primer during the resizing stroke when the shotgun shell is pushed past the annular lip 80' of the die 74 by ram head 132.

The operation of the resizing/ejector assembly 20 of the present invention, in cooperation with the ram head 22, is substantially identical to that set forth in my prior U.S. Pat. No. 3,979,995, the disclosure of which is incorporated herein by reference. Generally, during the resizing operation, a shell is pushed past the annular lip 80' of resizing die 74 by head 24 of ram 22 when the hand lever 26 is moved from the position in FIG. 2 downwardly. Simultaneously, the ram 22 moves the ejector assembly 25 to the left as illustrated in FIG. 3 so as to eject the previously-resized shall casing from the die 72.

The indexing pin 18 in combination with the slot 110 in the central portion of the ejector assembly 25 defines the limit of travel of the latter within indexing tube 70. Further, after each resizing/ejection stroke of the hand lever 26, a new shell is manually installed in the lower end of the assembly and the indexing tube 70 may then be manually rotated, either clockwise or counter-clockwise, until the newly installed shell is brought adjacent the head 24 of ram 22 ready for resizing. The proper position is defined by the engagement of the end 98 of spring 92 in either notch 100 or notch 102, as the case may be. The groove 90 in die alignment cam 66 affords positive cam tracking by end 98 of the spring 92, and provides simple, straightforward and inexpensive manual indexing.

Once the shotgun shell is deprimed by the depriming rod 126 on the downward stroke of the ram head 24, it simply rests loose in the base of the shell after the ram head 24 is withdrawn upwardly. After the indexing tube 70 has been manually indexed, the primer will be propelled in the direction of motion, either clockwise or counter-clockwise, into an appropriately positioned container.

By virtue of the foregoing, I have provided an extremely simplified, yet useful and advantageous shell casing resizer which both resizes and ejects on a single stroke of a hand-operated lever. The manual indexing, unitized frame, and other design features of the present invention greatly reduce costs of the device by reducing the number of moving and cooperating parts.

Obviously, numerous modifications and variations of the present invention are possible in light of the above teachings. It is therefore to be understood that within the scope of the appended claims, the invention may be practiced otherwise than as specifically described herein.

I claim as my invention:

1. A machine for resizing used shell casings, which comprises:

a pair of cooperating die means each of which is adapted to receive a shell casing for resizing same;

means for applying force to one of said shell casings to urge same past its associated die means;

means further responsive to said force for automatically ejecting the other of said shell casings from the other of said die means; and means coupled to said pair of cooperating die means for permitting manual indexing thereof for successively and alternately positioning each of said pair of die means adjacent said means for applying force to one of said shell casings.

2. The machine as set forth in claim 1, wherein said means coupled to said pair of cooperating die means comprises a cam member coupled for rotation with said die means about an indexing axis, and spring means which cooperates with said cam member for causing same to stop rotating at first and second positions which correspond to the placement of said pair of die means adjacent said means for applying force to one of said shell casings.

3. The machine as set forth in claim 2, wherein said cam member comprises a disc-shaped cam having a pair of oppositely disposed notches formed therein for receivably retaining said spring means when positioned opposite thereto.

4. The machine as set forth in claim 3, wherein said spring means comprises a spring member having one end secured against movement and the other end shaped to the shape of said pair of notches in said cam.

5. The machine as set forth in claim 4, wherein said cam further includes an arcuate surface formed about the peripheral edge thereof within which said other end of said spring member is adapted to be guided.

6. The machine as set forth in claim 1, wherein said die means comprises a substantially cylindrical tubular member having a pair of resizing dies positioned one at each end thereof.

7. The machine as set forth in claim 6, wherein each of said resizing dies includes an inwardly extending annular lip, and is further threaded so as to be removably attached to each end of said tubular member.

8. The machine as set forth in claim 6, further comprising a main frame having a pair of laterally spaced, elongated support arms between the free ends of which is pivotally mounted said tubular member.

9. The machine as set forth in claim 8, wherein said means coupled to said pair of cooperating die means for permitting manual indexing thereof comprises a cam member coupled to the outside of said tubular member for rotation therewith about an indexing axis, and spring means which is coupled with said cam member for causing same to stop rotating at selected positions thereof.

10. The machine as set forth in claim 9, further comprising an indexing pin positioned through said cam member, said tubular member and said free ends of said support arms and defining said indexing axis.

11. The machine as set forth in claim 10, wherein said spring means comprises a spring member having one end secured to one of said support arms and the other end positioned adjacent said cam member for engagement thereby.

12. The machine as set forth in claim 8, wherein said automatic ejecting means are disposed within said tubular member and include means for permitting lateral movement therein in response to said force applying means.

13. The machine as set forth in claim 12, further comprising an indexing pin coupled to said free ends of said support arms and extending through and defining a pivot axis for said tubular member and said automatic ejecting means.

14. The machine as set forth in claim 13, wherein said means for permitting lateral movement of said automatic ejecting means comprises an elongated slot formed in a central portion of said automatic ejecting means, said indexing pin extending through said elongated slot.

15. The machine as set forth in claim 14, wherein said automatic ejecting means comprises a pair of substantially identical ejection assemblies coupled one to each end of said central portion.

16. The machine as set forth in claim 15, wherein each of said ejection assemblies comprises primary ejector means over which said shell casing is placed by said force applying means, said primary ejector means for initially ejecting its associated shell casing in response to said force applied to the other of said shell casings.

17. The machine as set forth in claim 16, wherein each of said ejection assemblies further comprises secondary ejector means disposed within said primary ejector means for finally ejecting said associated shell casing from its respective die means.

18. The machine as set forth in claim 17, wherein each of said ejection assemblies includes a deprimer rod longitudinally positioned therein and coupled at one end to said central portion.

19. The machine as set forth in claim 18, wherein each of said ejection assemblies further comprises a spring positioned about said deprimer rod and between said central portion and said secondary ejection means for urging the latter outwardly against the inner surface of its associated shell casing.

20. The machine as set forth in claim 8, wherein said force applying means comprises a hand-operated lever coupled to said main frame for movement between first and second positions, and ram means for reciprocating in response to the movement of said lever, said ram means including a head for directly pressing against said one of said shell casings while said lever is being moved from said second position to said first position.

21. The machine as set forth in claim 20, wherein said hand-operated lever is decoupled from said tubular member while said lever is being moved from said first position to said second position.

* * * * *